United States Patent [19]

Nakano

[11] 3,997,752

[45] Dec. 14, 1976

[54] COOKING TIME INDICATION ARRANGEMENT FOR USE IN MICROWAVE OVEN

[75] Inventor: Chikao Nakano, Yamato Koriyama, Japan

[73] Assignee: Matsushita Electric Industrial Co., Ltd., Osaka, Japan

[22] Filed: Sept. 22, 1975

[21] Appl. No.: 615,706

[30] Foreign Application Priority Data

| | | |
|---|---|---|
| Oct. 4, 1974 | Japan | 49-120613[U] |
| Oct. 8, 1974 | Japan | 49-121986[U] |
| Sept. 26, 1974 | Japan | 49-116703[U] |

[52] U.S. Cl. ..... 219/10.55 R; 116/129 R; 219/10.55 E

[51] Int. Cl.[2] ..... H05B 9/06

[58] Field of Search ..... 219/10.55 E, 10.55 R; 116/124.1 A, 124.1 R, 115, 133, 129 R, 129 H, 129 Q, 129 P, 129 M, 129 L; 58/126 E

[56] References Cited

UNITED STATES PATENTS

| | | | |
|---|---|---|---|
| 3,468,388 | 9/1969 | Labore et al. | 116/129 R X |
| 3,590,774 | 7/1971 | Solow | 116/129 R X |
| 3,848,105 | 11/1974 | Mori | 219/10.55 E |

*Primary Examiner*—Arthur T. Grimley
*Attorney, Agent, or Firm*—Wenderoth, Lind & Ponack

[57] ABSTRACT

A cooking time indication arrangement for use in a microwave oven which includes a rotary drum of light transmitting nature having a plurality of menus to be cooked imprinted on it, a timer scale and a pointer needle associated with a timer, and an illuminating lamp enclosed in the rotary drum. The drum is rotatably supported by bearings through end members provided at its opposite ends for smooth rotation, while the illuminating lamp having high vibration resistance is adjustably supported by a securing plate, and the menu indication on the drum being prevented from becoming wrinkled due to temperature variations.

16 Claims, 14 Drawing Figures

COOKING TIME INDICATION ARRANGEMENT FOR USE IN MICROWAVE OVEN

The present invention relates to a microwave oven and, more particularly to a cooking time indication arrangement for use in the microwave oven.

a microwave oven to which the present invention is applicable and which is now in wide use generally comprises an oven-defining structure or oven chamber having a hingedly supported door adapted to selectively open and close an access opening formed at one side of the oven chamber, a magnetron assembly for generating high frequency energy for heat-treating an object or food material within the oven chamber, a timer unit for adjusting the period of time during which the magnetron is operated so as to apply the high frequency energy to one particular food material, and indication means including a timer scale associated with a timer knob and a heating time setting scale for setting heating time suitable for particular kinds and quantities of food. The indication means normally disposed on a control panel at the front upper portion of the oven is indispensable to such high class cooking apparatuses so as to permit anyone to easily operate the same, and it is a matter of primary concern for manufacturers of such microwave ovens to incorporate as many kinds of menus to be cooked as possible in the indication means, which unavoidably results in the letters to be imprinted the indication means being small sized, and unless sufficient illumination thereof is available, the letters tend to be hard to read. Accordingly, the illumination of the indication means presents serious problems not only from the manufacturing point of view, but on the part of the users for easy and efficient reading in order to carry out cooking.

Such indication means further includes a display window in which a rotary drum or cylinder is rotatably provided, while a plurality of different menus that can be cooked in different cooking times are imprinted on the peripheral surface of the drum which is desirably of light transmitting material such as synthetic resin for illumination, for example, through a lamp enclosed in a hollow space inside of the drum. Commonly, such a drum has a pair of opposed end plates integrally formed with axial projections in alignment with the longitudinal axis of the drum respectively, with a drum operating wheel rigidly secured on one of the projections, and a metallic shaft or bolt threaded at opposite ends thereof extends through the projections for rigidly securing the end plates to the drum through corresponding nuts. The drum and end plates thus assembled are rotatably supported in position, at the projections thereof by a corresponding pair of bearings fixed on a support plate for being mounted on the control panel. The conventional indication means of the above described construction, however, has the disadvantage that, if a lamp is disposed within the drum for illuminating the menu indication, the shadow of the bolt inevitably falls on the menu indication portion, thus hindering the clarity thereof. In some of the conventional indication means, the lamp is disposed outside of the drum, in which case, however, the indication is somewhat illegible due to reflection of light on the drum surface, although the drum itself need not necessarily be of light transmitting nature in such cases. It is another disadvantage in the conventional indication means that the lamp for illumination housed within the drum tends to be easily broken, especially the filament thereof, due to shock during operation, which fact requires an improved construction and holding method for such lamps for prolonged life thereof.

Additionally, it is a common practice in the manufacture of such conventional indication means that a sheet of resinous material such as polyester or the like having menus imprinted on one surface thereof is stuck on the outer periphery of the drum by adhesive applied to the other surface of the sheet, in which case, if the drum is of resinous material of a light transmitting nature for illuminating the menu sheet by means of the lamp enclosed in the drum, many large wrinkles tend to appear in the menu sheet due to expansion and contraction of the drum as it is subjected to repeated heating and cooling during cooking, which trend is further aggravated by the heat of the lamp accommodated in the drum.

Furthermore, should the axial projections of the end plates and the bearings both be made of resinous materials, the smooth rotation of the drum by the rotating wheel is hindered, with creaking noises being generated between the projections and the bearings, especially when the end plates and the bearings are heated by the heat radiated by the lamp or oven.

Accordingly, an essential object of the present invention is to provide a cooking time indication arrangement for use in a microwave oven which includes a display device having a hollow drum within which an illuminating lamp is housed for clear indication of the menus to be cooked, with consequent improvement of commercial value and easiness ease in handling of the microwave ovens.

Another important object of the present invention is to provide a cooking time indication arrangement of the above described type in which the illuminating lamp having improved shock resistance is detachably enclosed within the hollow drum for uniformly illuminating the entire indication surface.

A further object of the present invention is to provide a cooking time indication arrangement of the above described type in which the illuminating lamp is enclosed within the hollow drum in such a manner that the same is adjustable in the circumferential direction for optimum illumination through the provision of an improved securing plate for a socket for the illuminating lamp, with heat radiated from said illuminating lamp being efficiently discharged from the drum.

A still further object of the present invention is to provide a cooking time indication arrangement of the above described type in which a menu indication sheet stuck on the drum is prevented from becoming wrinkled due to expansion and contraction of the drum through temperature variations.

Another object of the present invention is to provide a cooking time indication arrangement of the above described type which is accurate in operation and simple in construction with consequent good performance and reduction in cost.

According to a preferred embodiment of the present invention, the indication arrangement includes an indication means having a display window, in which a hollow drum of light transmitting resinous material is rotatably disposed for rotation through an adjusting wheel or rotating wheel secured to one end of the drum, while a disc member and tubular member having axial projections thereon are fitted in opposite ends of the drum, with the axial projections supported by corresponding bearings fixed on a support plate, and with the disc member suitably urged toward the drum and the tubular member by a spring disposed on the projection between the disc member and the corresponding bearing, by which arrangement, the bolt or the like for connecting the end plates and the drum is advantageously eliminated, thus the menus indicated on the drum surface being clearly illuminated by the illuminating means such as a lamp enclosed in the drum. Within the hollow space in the drum, the illuminating lamp with improved shock resistance is releasably supported in a socket which is in turn secured, through a securing plate, to one surface of the bearing receiving therein the axial projection of the tubular member of the drum, with the bearing being fixed to the supporting plate for the indication means, whereby the lamp is adjustable in the circumferential direction thereof for optimum illumination of the menu indication sheet on the periphery of the drum. Since the disc member of the drum is provided with a plurality of openings for ventilation therein, the heat generated by the lamp is discharged through the openings and the tubular member at the other end of the drum for preventing over-heating within the drum. Furthermore, in the indication arrangement of the invention, the menu indication sheet is stuck on the drum surface by adhesive applied only to narrow portions adjacent to front and rear edges of the sheet, by which arrangement, formation of any wrinkles on the indication sheet due to expansion and contraction of the drum resulting from temperature variations is also advantageously eliminated.

These and other objects and features of the present invention will become apparent from the following description taken in conjunction with the preferred embodiment thereof with reference to the accompanying drawings, in which.

Before the description of the present invention proceeds, it is to be noted that like parts are designated by like numerals throughout several views of the accompanying drawings.

Figure 1:
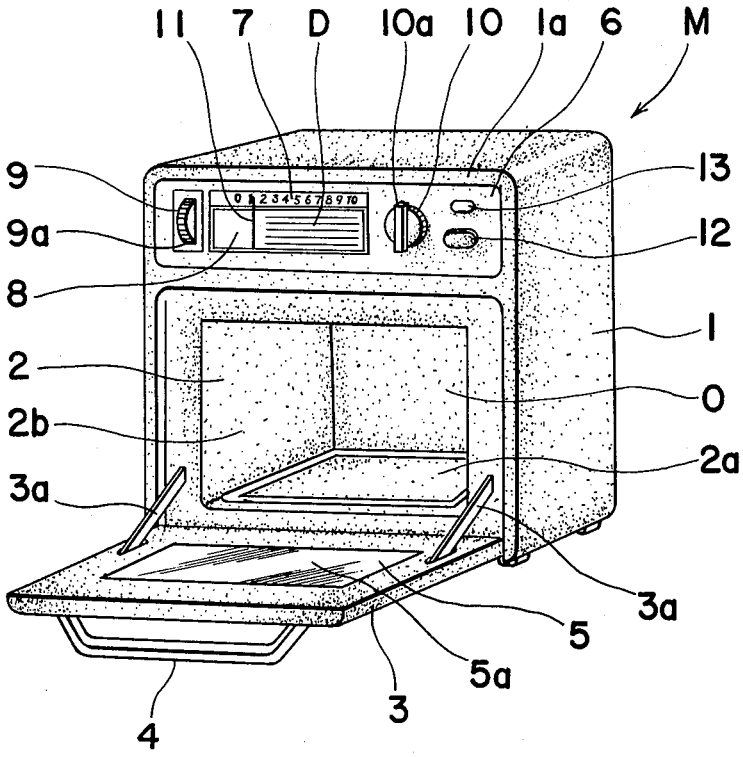
FIG. 1 is a schematic perspective view of a microwave oven in which the cooking time indication arrangement of the invention is incorporated.
Figure 2:
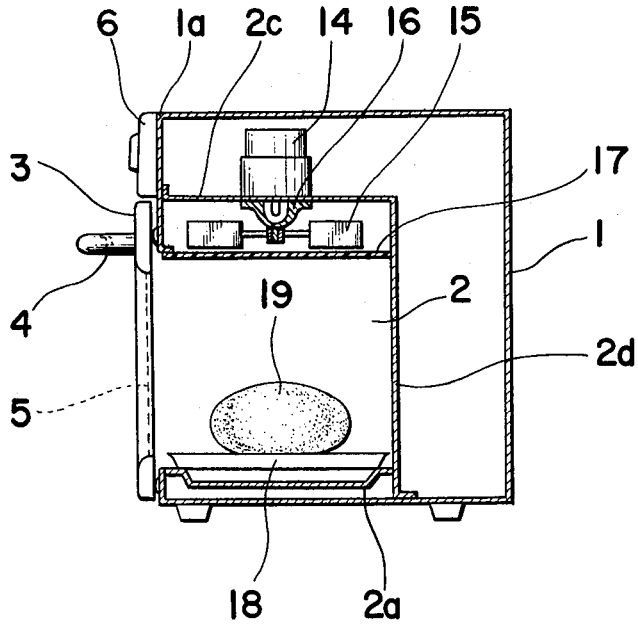
FIG. 2 is a schematic side sectional view of the microwave oven of FIG. 1.

Referring to FIGS. 1 and 2, there is shown a microwave oven M to which the present invention is applicable. The microwave oven M includes an outer casing 1 of cubical box-like configuration open at the front side thereof, which outer casing 1 has a double wall structure and comprises inner walls which are suitably made of steel plate or similar material and define an oven-defining structure or oven chamber 2, these inner walls including a horizontal base plate 2*a*, vertical side walls 2*b*, a top wall 2*c* and a rear wall 2*d* and thus defining an access opening 0 at the front of the oven. Outer surfaces of the walls 2*a*, 2*b*, 2*c* and 2*d* are spaced from the corresponding walls of the center casing 1 so as to provide spaces therebetween. The outer casing 1 further includes an outside front wall portion 1*a* immediately above the access opening 0, on which front wall portion 1*a*, there is mounted a control panel 6 including the cooking time indication arrangement described later which is directly related to the present invention.

The microwave oven M further includes a door 3 provided with a handle 4 adjacent to one edge thereof remote from the hinge by which the door 3 is supported at the lower edge thereof to the lower front edge of the casing 1, in a position corresponding to the access opening 0 for selectively opening and closing the opening 0, through which food to be heated is inserted into the oven chamber 2. More specifically, the door 3 is formed with a rectangular opening 5 in the central portion thereof, in which opening 5 a transparent plate member and a shielding screen plate or the like (not shown) for shielding the microwaves are closely fitted to form an observation window 5*a* in the door 3 for the observation of an object 19 placed on a vessel 18 therethrough. The main casing 1 further includes an interior portion which provides sliding accommodation for a pair of door arms 3*a*, each of which is attached to a lower side portion of the door 3 and passes through a portion between the side wall of the casing 1 and the corresponding side wall 2*b* of the oven chamber 2.

Referring particularly to FIG. 2, in the space defined by the top wall of the casing 1 and the corresponding top wall 2*c* of the oven chamber 2, there are disposed, generally in the central portion of the wall 2*c*, a magnetron assembly 14 for radiating high frequency energy into the oven chamber 2, a stirrer fan 15 which is rotatably supported by a shaft 16 extending into the chamber 2 and which is adapted to rotate for stirring the high frequency energy in the chamber 2 by the air flow caused by blower means (not shown) for cooling the magnetron assembly 14. Immediately below the stirrer fan 15, a partition plate 17 is disposed in spaced relation to the fan 15 and in a direction parallel to the top wall 2*c*, which partition plate 17 is supported at opposite edges thereof, by a lower edge of the front wall 1*a* of the casing 1 and the rear wall 2*d* of the heating chamber 2. The horizontal base plate 2*a* of the chamber 2 is provided with a concave portion in the central part thereof and is suitably connected to a front upwardly bent edge of the bottom plate of the casing 1 and the rear wall 2*d* of the heating chamber 2, with a space being left between the bottom plate of the casing 1 and the base plate 2*a*, on which base plate 2*a*, the object 19 mounted on the vessel 18 of non-metallic material, is placed.

Figure 3:
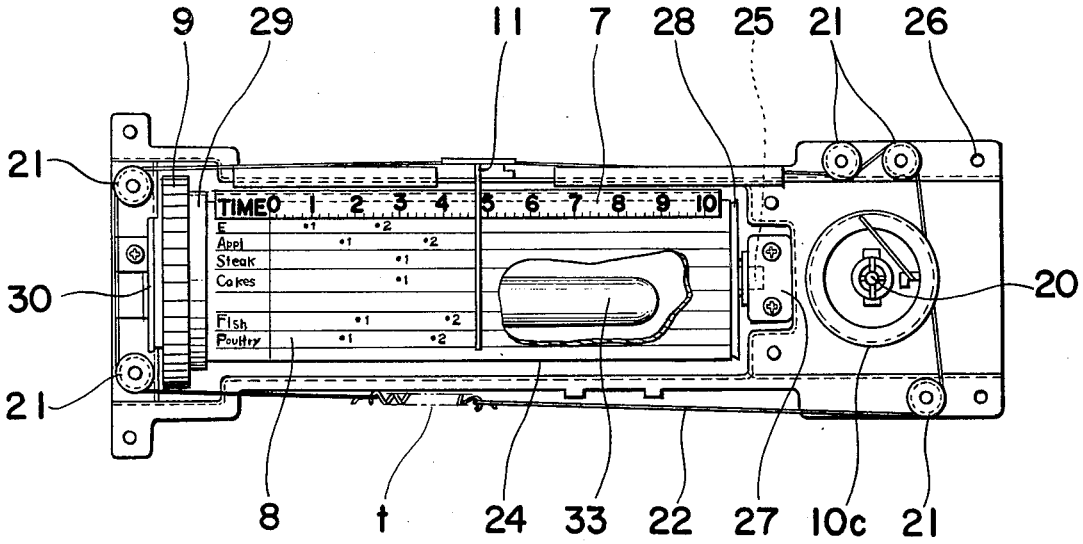
FIG. 3 is a front elevational view partly broken away, showing on an enlarged scale, the cooking time indication arrangement of FIG. 1.
Figure 8:
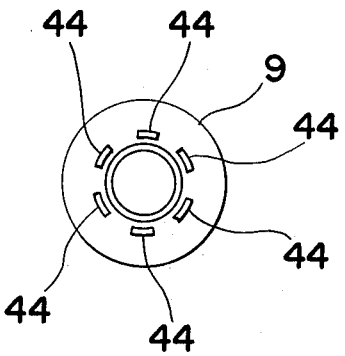
FIG. 8 is an end elevational view of the tubular member of FIG. 4.
Figure 10:
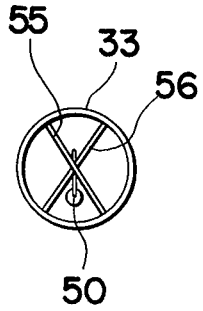
FIG. 10 is an end view of the illuminating lamp of FIG. 9.
Figure 9:
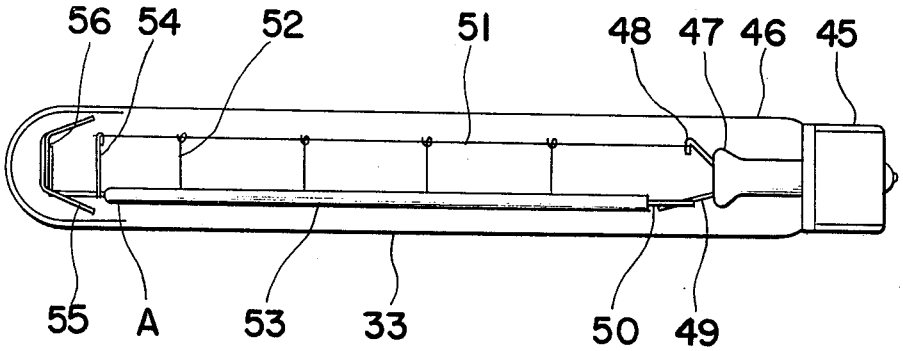
FIG. 9 is a side elevational view of an illuminating lamp employed in the arrangement of FIG. 3.
Figure 11:
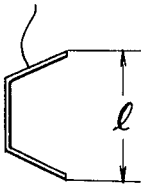
FIG. 11 is a side elevational view, on an enlarged scale, of a U-shaped wire employed in the lamp of FIG. 9.

Referring also to FIGS. 3 and 8, the control panel 6 provided on the front wall portion 1*a* of the oven M is formed with a display window D which is provided with a timer scale 7 at the upper portion thereof and through which a portion of a rotatable drum 24 having a heating time setting scale 8 for a plurality of menus imprinted on the peripheral surface thereof and a pointer needle 11 are exposed to the sight of the user, and also with a substantially vertically extending slot 9*a* through which a portion of a drum rotating wheel 9 for rotating the drum 24 is exposed for permitting the user to rotate the drum 24 to register one particular menu on the peripheral surface of the drum 24 by the pointer needle 11. Provided to the right of the display window D are a timer operating knob 10*a* for a timer 10 mounted on a timer operating shaft 20 (FIG. 3) extending through the control panel 6, a pushbutton type switch 12 for initiating, upon depression thereof, radiation of high frequency energy toward the food within the oven chamber 2, and a cooking indicator 13. The pointer needle 11, during the operation of the timer 10, moves from one position corresponding to the cooking time proper for one particular food in the oven chamber 2 to another position, i.e., an OFF position, thereby visually representing the elapse of the cooking time. For this purpose, the timer operating shaft 20 has a drive wheel 10*c* (FIG. 3) fixedly mounted thereon, and rotation of the timer operating shaft 20 is transmitted to the pointer needle 11 through the drive wheel 10*c* by means of a cable 22 which is connected to the wheel 10*c* and directed around a plurality of guide rollers 21 rotatably supported by a frame 26 for guiding the cable 22, with the cable 22 having a pair of opposed ends connected with each other by a tension spring t. As the timer knob 10*a* is rotated, the cable 22 is moved to bring the pointer needle 11 to a desired position on the timer scale 7 on the display window D.

Figure 4:
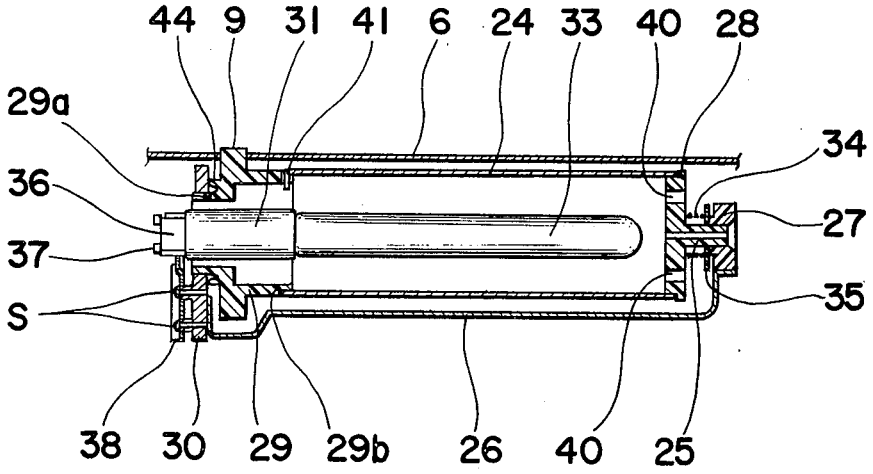
FIG. 4 is a cross sectional view showing the construction of a rotary drum and bearings of the arrangement of FIG. 3.
Figure 6:
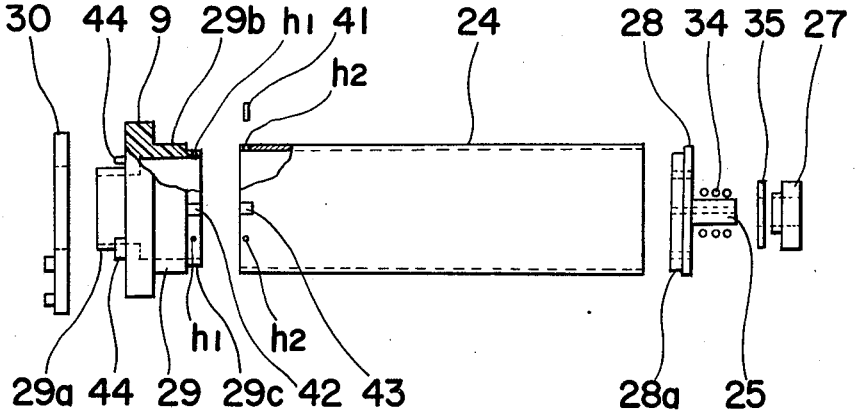
FIG. 6 is an exploded view, partly broken away, of the drum and bearing construction of FIG. 4.
Figure 7:
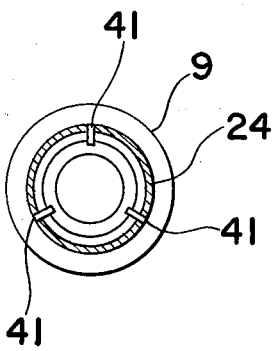
FIG. 7 is a cross sectional view showing the connection between a tubular member and the drum of FIG. 6.

Referring particularly to FIG. 4, the drum 24 of light transmitting material, for example, synthetic resin has, at one end thereof, a disc member 28 having thereon an axial projection 25 integral therewith, while a tubular member 29 integral with the drum rotating wheel 9 and housing an axial hollow projection 29*a* is provided at the other end of the drum 24, with the axes of the projections 25 and 29*a* being in alignment with the longitudinal axis of the drum 24 respectively. The side of the disc member 28 opposite to the projection 25 and facing the end of the drum 24 is provided with a portion 28*a* with a reduced diameter so as to be closely fitted into the corresponding end of the drum 24, while the side 29*b* of the tubular member 29 remote from the projection 29*a* is also provided with a reduced diameter portion 29*c* (FIG. 6) coaxial with the member 29 so as to be fitted into the corresponding end of the drum 14. At least one projection 42 is provided on the periphery of the portion 29*c* to be received in a corresponding notch 43 formed in the end of the drum 24 for preventing relative movement therebetween, while a plurality of corresponding openings *h*1 and *h*2 are formed in the portion 29*c* of the tubular member 29 and the end of the drum 24 respectively for inserting pins 41 therethrough for positively securing the member 29 to the drum 24.

The drum 24 is rotatably supported in position by the frame 26 (FIG. 4) having bearing blocks 30 and 27 rigidly secured to the frame 26 and respectively receiving therein the axial projections 25 and 29*a* of the members 28 and 29.

It should be noted here that the disc member 28 further has a plurality of openings 40 (FIG. 4) in positions adjacent to the outer periphery thereof for discharging, in cooperation with the hollow interior of the member 29, the air heated by a lamp 33 enclosed in the drum 24 in a manner described later.

The drum 24 is normally urged in one direction towards the bearing 30 of comparatively hard metallic material by a compression spring 34 which is mounted on the axial projection 25 and disposed between the disc member 28 and the bearing 27 for imparting a sufficient friction to the rotation of the cylinder 24 so as to avoid any axial play between the cylinder 24 and the member 28. A washer 35 of sufficient size is disposed between the bearing 27 and the spring 34 for facilitating smooth rotation of the drum 24. On the side of the rotating wheel 9 integral with the axial projection 29*a* and facing the bearing 30, are a plurality of projections 44 (FIG. 8) are axially lying on an imaginary circle concentric with the rotating wheel 9 and extending parallel with the drum axis for partial contact with the surface of the bearing 30 so as to reduce the force required for the rotation of the drum 24 and thus achieve smooth rotation of said drum 24.

Figure 5:
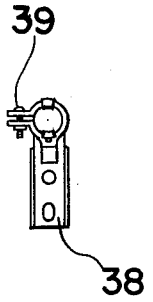
FIG. 5 is a top plan view, on an enlarged scale, of a securing plate for a lamp socket employed in the arrangement of FIG. 3.

Within the hollow interior of the rotary drum 24, the lamp 33 for illuminating the heating time setting scale 8 on the outer periphery of the drum 24 is releasably secured in a socket 31 which is housed in the hollow interior of the tubular member 29. The socket 31 is a further provided with a holder portion 36 of approximately circular cross section integral with or rigidly connected to the bottom of the socket 31 and having a plurality of radially extending small projections 37 at the extreme outer edge thereof. The holder portion 36 is releasably received between a pair of opposed plates of semi-circular cross section at one end of a securing plate 38, with said opposed plates adapted to selectively hold the portion 36 tightly or loosely therebetween by rotation of an adjusting screw 39 (FIG. 5), while the other end of the plate 38 is flattened so as to be secured to one surface of the bearing 30 by securing screws S. When the screw 39 is tightened with the holder portion 36 held between the opposed plates of the securing plate 38, the lamp 33 is fixedly disposed in the drum 24, while the circumferential direction of the lamp 33 is readily adjustable by loosening the screw 39 for properly rotating the lamp 33, in which case, falling of the lamp 33 and socket 31 off the securing plate 38 is positively prevented by the presence of the projections 37.

In the above arrangement, it is to be noted that, since the bearing 27 for the axial projection 25 is disposed in a plane normal to the longitudinal axis of the drum 24, the bearing 30 for the axial projection 29*a* of the member 29 can be disposed in an extremely small space with respect to the direction of the longitudinal axis of the drum 24. Moreover, since the bearing 30 is composed of relatively hard metal, unlike the conventional arrangement wherein both bearing and the projection are made of resinous material, the problems of creaking noises developed upon rotation of the rotating wheel 9 or of retardation of the smooth rotation of the wheel 9 are advantageously prevented, even when the temperatures of the projection 29*a* and the bearing 30 are raised by the heat radiated from the lamp 33. The provision of the projection 29*c* on the member 29 for engaging with the notch 43 of the drum 24 is effective not only for quick positioning of the member 29 with respect to the drum 24, but also for providing a rigid connection between the member 29 and the drum 24 together with the provision of the pins 41 positively connecting the two. Although the member 28 engages the drum 24 mainly by the urging force of the spring 34, relative movement between the two is fully prevented, since the force acting on this portion is almost negligible, by which simple arrangement, efficiency in manufacturing is markedly improved. Furthermore, by the provision of the specially designed securing plate 38 for holding the lamp 33 in position within the drum 24, the positional adjustment of the lamp 33 in the circumferential direction thereof can be readily effected to prevent the shadow of a filament support described later from falling on the surface of the drum 24. Additionally, the provision of the projections 37 at the extreme peripheral edge of the holder portion 36 of the socket 31 advantageously prevents the socket 31 from falling off the securing plate 38, even when the socket 31 and the plate 38 are subjected to repeated vibrations during rotation of the drum 24.

Referring now to FIGS. 9 to 12, there is shown the lamp 33 employed in the arrangement of the invention.

The lamp 33 generally comprises a base 45 made, for example, of brass to be received in the socket 31, a cylindrical glass tube or bulb 46 fixed to the base 45 at its one end, with the other end thereof closed, a stem 47 extending into the bulb 46 from the base 45, lead-in wires 48 and 49, for example, of pure iron extending from the stem 47 in spaced relation to each other, a thick main support wire 50, for example, of tungsten welded to the lead-in wire 49 at its one and bent L-shape at the other end thereof adjacent to the closed end of the bulb 46, with the support wire 50 being covered with a hollow glass tube 53 which has an inner diameter somewhat larger than the diameter of the support wire 50, and with the glass tube 53 being fused to the wire 50, at one end A thereof, in a position spaced to a certain extend from the L-shaped end of the support wire 50 so as to cover the remaining portion of the support wire 50, a filament support 54, for example, of pure iron welded to the support wire 50 in a position adjacent to the fused point A of the glass tube 53, a filament 51 having one end thereof caulked to the lead-in wire 48 and the other end thereof also caulked to the upper end of the filament support 54, a plurality of auxiliary filament support wires 52, for example, of molybdenum further disposed between the filament 51 and the glass tube 53 for supporting the filament 51, with one end of each support wire 52 being suitably fixed on the glass tube 53 and insulated from the main support wire 50, and a pair of U-shaped wires 55 and 56 each having a distance $l$, between the opposed ends thereof, somewhat larger than the internal diameter of the bulb 46, the wires 55 and 56 being crossed and welded to each other at the central portions thereof and enclosed in the closed end of the bulb 46 so that the crossed portion of the wires 55 and 56 engages the L-shaped end of the main support wire 50 (FIG. 10), with the ends of the welded wires 55 and 56 being pressed against the inner wall of the bulb 46, so that the L-shaped end of the main support wire 50 is supported by the elasticity of the wires 55 and 56 for preventing the main support wire 50 and the filament 51 from vibrating.

Figure 12:
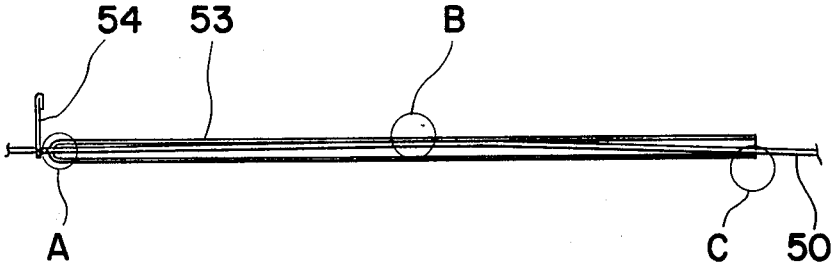
FIG. 12 is a side elevational view, on an enlarged scale, particularly showing the construction of a main support wire employed in the lamp of FIG. 9.

Referring to FIG. 12, the main support wire 50 in the above construction is slightly bent to contact, by the elasticity thereof, the inner surface of the glass tube 53 at a point B in the central portion of the tube 53 and also at a point C at the end of said glass tube 53, thus supporting the glass tube 53 at three points, i.e., the fused point A and the above points B and C, by which arrangement, the disadvantages in the conventional constructions such as breakage of the glass tube by vibration due to only one point support for the glass tube, short life of the bulb through gradual decrease of vacuum therein due to air remaining in the glass tube even when the glass tube is fused at opposite ends thereof to the main support wire, and difficulties in forming small openings for ventilation in the periphery of the glass tube for lengthening the life of the bulb are advantageously eliminated with remarkably improved shock resistance of the bulb itself.

Figure 13:
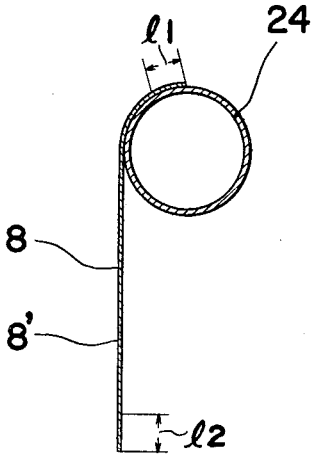
FIGS. 13 and 14 are schematic transverse sectional views showing the relation between the rotary drum and indication scale employed in the arrangement of FIG. 3.
Figure 14:
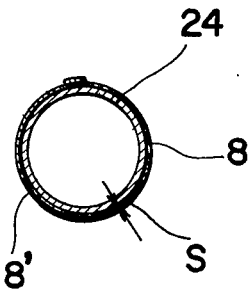

Referring now to FIGS. 13 and 14, the drum 24 of light transmitting resinous material, for example, of polycarbonate further includes a sheet of film 8′ also of light transmitting resinous material such as polyester having dimensions sufficient to cover the entire outer periphery of the drum 24 and also having the plurality of menus imprinted on the outer surface thereof to form the heating time setting scale 8 on the drum 24. As is clearly shown in FIG. 13, suitable known adhesive is applied only to narrow portions $l1$ and $l2$ on the back surface of the sheet 8′, adjacent to opposite edges thereof extending across the width of the drum 24, which sheet 8′ is then stuck on the surface of the drum 24 as in FIG. 14, with a slight clearance S being kept between the sheet 8′ and the drum 24, which arrangement is not only effective for preventing formation of wrinkles on the scale 8 arising from expansion and contraction of the drum 24 due to temperature variations, but results in considerable saving in the amount of adhesive required. Furthermore, should the sheet 8′ be improperly applied to the drum 24 during manufacturing, the same sheet 8′ is readily peeled off the drum surface for positional correction. Additionally, since the adhesive is applied to only a part of the sheet 8′, reduction in fundamental clarity of the sheet 8′ and deterioration in appearance of the scale 8 resulting from discoloration of the adhesive due to heat or aging are advantageously eliminated.

It should be noted here that the adhesive described as applied to the sheet 8′ adjacent to the front and rear edges thereof in the above embodiment is not necessarily applied to such particular portions, but may be applied to other portions of the sheet 8′, for example, to portions adjacent to side edges thereof or to only particular coners of the same so long as a suitable clearance is formed between the sheet 8′ and the drum 24 for absorbing variations of the drum dimensions due to expansion or contraction thereof.

As is clear from the foregoing description, according to the cooking time indication arrangement of the invention, the menus to be cooked are clearly and definitely indicated by the employment of the drum supported by the specially designed end members and corresponding bearings for smooth rotation, the illuminating lamp having highly improved shock resistance, and the cooking time setting scale being free from wrinkles or discoloration, with substantial elimination of the disadvantages inherent in the conventional indication arrangements.

Although the present invention has been fully described by way of example with reference to the attached drawings, it is to be noted that various changes and modifications are apparent to those skilled in the art. Therefore, unless otherwise such changes and modifications depart from the scope of the present invention, they should be constructed as included therein.

What is claimed is:

1. A cooking time indication arrangement for use in a microwave oven, said arrangement being for a microwave oven including an oven-defining structure having an access opening, means provided for generating high frequency energy directed toward the interior of said oven-defining structure and a hingedly supported door for selectively opening and closing the access opening of said oven-defining structure, said indication arrangement comprising timer means for setting cooking time and display means for visually representing various information relating to menus, said display means further including a display window, a pointer needle in said display window and associated with said timer means, and a rotary drum member associated with said pointer needle and having a plurality of menus and corresponding cooking times indicated on the peripheral surface thereof for observation through said display window said rotary drum member having a tubular member and a disc member fitted into opposite ends thereof, said tubular members having an axial hollow projection and said disc member having an axial projection integrally connected thereto, said axial hollow projection and said axial projection being in alignment with longitudinal axis of said rotary hollow drum member, and a frame having bearings thereon receiving said projections for rotation of said drum member, a rotating wheel coupled to said tubular member and being rotatable from outside of the microwave oven for rotating said rotary drum member for registering one particular menu in said plurality of menus, and illuminating means in said drum member for illuminating said peripheral surface of said drum member.

2. a cooking time indication arrangement as claimed in claim 1, wherein said lamp extends into interior of said drum member through said tubular member.

3. A cooking time indication arrangement as claimed in claim 1, wherein a plurality of pins extend through said tubular member into the corresponding end of said rotary drum member for connecting said tubular member, thereto and a compression spring positioned on said axial projection between said disc member and the corresponding bearing for urging and securing said disc member to the corresponding end of said rotary drum member.

4. A cooking time indication arrangement as claimed in claim 1, wherein said tubular member is made of metallic material.

5. A cooking time indication arrangement as claimed in claim 1, wherein said bearing receiving therein said axial hollow projection of said tubular member is made of metallic material.

6. A cooking time indication arrangement as claimed in claim 1, wherein said disc member for said rotary drum members has a plurality of ventilation openings therein, the hollow interior of said tubular member and said corresponding bearing also serving as a ventilation opening.

7. A cooking time indication arrangement as claimed in claim 1, wherein said rotary drum member is made of light transmitting material with said plurality of menus and corresponding cooking times indicated on the peripheral surface thereof.

8. A cooking time indication arrangement as claimed in claim 7, wherein said indication on said peripheral surface of said rotary drum member includes a film of light transmitting material having said plurality of menus and corresponding cooking times imprinted on the outer surface thereof and adhesive applied to limited portions of the back surface of said film and adhering said film to said peripheral surface.

9. A cooking time indication arrangement as claimed in claim 8, wherein small clearance is provided between said film and said peripheral surface of said rotary drum member for providing a portion whereat said film contacts the peripheral surface of said rotary drum member loosely.

10. A cooking time indication arrangement as claimed in claim 1, wherein said rotating wheel is integral with said tubular member and has, at one side thereof facing the corresponding bearing, a plurality of projections positioned along an imaginary circle concentric with said rotating ring for partially contacting said corresponding bearing.

11. A cooking time indication arrangement as claimed in claim 1, wherein one side of said bearing facing the corresponding one side of said rotating wheel has a plurality of projections positioned along an imaginary circle concentric with said bearing for partially contacting said corresponding one side of said rotating wheel.

12. A cooking time indication arrangement for use in a microwave oven, said arrangement being for a microwave oven including oven-defining structure having an access opening, means provided for generating high frequency energy directed toward the interior of said oven-defining structure and a hingedly supported door for selectively opening and closing the access opening of said oven-defining structure, said indication arrangement comprising timer means for setting cooking time and display means for visually representing various information relating to menus, said display means further including a display window, a pointer needle in said display window associated with said timer means, and a rotary drum member associated with said pointer needle and having a plurality of menus and corresponding cooking times indicated on the peripheral surface thereof for observation through said display window, a rotating wheel coupled to said rotary drum member for rotating said drum member from outside of the microwave oven for registering one particular menu in said plurality of menus, and a single lamp for illuminating said drum member and having a cylindrical configuration and the light from which is continuously distributed over entire length thereof for illuminating said peripheral surface of said drum member said lamp having a base, a cylindrical glass bulb fixed to said base at one end thereof, a stem extending into said cylindrical glass bulb from said base, lead-wires extending from said stem into said glass bulb, a main support wire secured to a corresponding end of one of said lead-in wires and extending into said cylindrical glass bulb to a position adjacent to the other end of said glass bulb whereat the other end of said main support wire is bent towards axis of said lamp, a glass tube covering said main support wire and having an internal diameter larger that the diameter of said main support wire, a filament connected between said other end of said main support wire and a corresponding end of the other of said lead-in wires, and a plurality of filament support wires radially outwardly extending from said glass tube in a direction parallel to said main support wire and supporting said filament, and a pair of elastic wires each having a distance between opposite ends thereof larger than the internal diameter of said glass bulb, said pair of elastic wires being crossed and secured to each other at central portions thereof and enclosed adjacent to said end of said glass bulb, the ends of said crossed wires being pressed against inner walls of said glass bulb and elastically supporting said other end of said main support wire.

13. A cooking time indication arrangement is claimed in claim 12, further comprising a socket for said base of said lamp a holder portion integrally connected to said socket, said holder portion having an approximately circular cross-section with respect to the longitudinal axis of said lamp, a securing plate for mounting on said oven defining structure and having a pair of opposed semicircular plates at one end of said securing plate and fitted around said holder, and screw means on said pair of opposed semi-circular plates for selectively securing said plates to or releasing said plates from said holder portion for permitting said lamp to be positionally adjusted in said plates in the circumferential direction thereof.

14. A cooking time indicating arrangement as claimed in claim 13, wherein said rotary drum member has a bearing for supporting one end thereof, and said securing plate is fixed, at the other end thereof, to one surface of said bearing.

15. A cooking time indication arrangement as claimed in claim 13, wherein said holder portion is further provided, at an extreme peripheral edge thereof, with a plurality of small projections radially outwardly extending therefrom for preventing said lamp from falling off said securing plate.

16. A cooking time indication arrangement as claimed in claim 12, wherein said glass tube covering said main support wire is fused, at one end thereof, to said main support wire, said main support wire being curved to such an extend that it contacts the inner surface of said glass tube at least two points.

* * * * *